US005677508A

United States Patent [19]

Finn et al.

[11] Patent Number: 5,677,508

[45] Date of Patent: Oct. 14, 1997

[54] MISSILE HAVING NON-CYLINDRICAL PROPULSION SECTION

[75] Inventors: Kevin P. Finn, Tucson; Homer H. Schwartz, II, Oro Valley; Tim S. Connel; Richard J. Snyder, both of Tucson; Youn H. Oh, Oro Valley, all of Ariz.

[73] Assignee: Hughes Missile Systems Company, Los Angeles, Calif.

[21] Appl. No.: 515,479

[22] Filed: Aug. 15, 1995

[51] Int. Cl.[6] ..... F42B 15/00

[52] U.S. Cl. ..... 102/374; 60/253; 244/3.1; 244/3.21; 244/3.24; 244/130

[58] Field of Search ..... 102/287, 291, 102/347, 374, 380, 381, 436; 244/3.1, 3.15, 3.21, 3.22, 3.24, 36, 130, 218; 60/253, 255

[56] References Cited

U.S. PATENT DOCUMENTS

| | | | |
|---|---|---|---|
| 3,121,312 | 2/1964 | Hopper | 244/3.22 |
| 3,175,497 | 3/1965 | Head | 102/374 |
| 3,202,381 | 8/1965 | Wuenscher | 244/3.21 |
| 3,468,501 | 9/1969 | Baum | 244/3.1 |
| 3,585,799 | 6/1971 | Geschwentner | 60/253 |
| 4,176,813 | 12/1979 | Headley et al. . | |
| 4,327,884 | 5/1982 | Lawhorn . | |
| 4,369,940 | 1/1983 | Kelly et al. | 244/3.21 |
| 4,674,712 | 6/1987 | Whitener et al. . | |
| 4,712,751 | 12/1987 | Hirschel . | |
| 4,736,913 | 4/1988 | Bennett et al. . | |
| 4,790,350 | 12/1988 | Arnold . | |
| 4,815,383 | 3/1989 | Ward et al. | 102/374 |
| 5,035,182 | 7/1991 | Purcell et al. | 60/253 |
| 5,086,996 | 2/1992 | Roeder et al. . | |
| 5,143,320 | 9/1992 | Boyadjian | 244/3.21 |
| 5,238,208 | 8/1993 | Davis . | |
| 5,309,712 | 5/1994 | Mund, Jr. | 60/253 |
| 5,363,767 | 11/1994 | Robinson | 102/374 |

FOREIGN PATENT DOCUMENTS

| | | | |
|---|---|---|---|
| 1170714 | 5/1964 | Germany | 102/287 |

OTHER PUBLICATIONS

"Rocket Propulsion Elements" by George P. Sutton, 1963 p. 360.

*Primary Examiner*—Harold J. Tudor

*Attorney, Agent, or Firm*—Charles D. Brown; Wanda K. Denson-Low

[57] ABSTRACT

A missile has a non-cylindrical fuselage over at least a portion of its length, with a non-cylindrical propulsion system contained within the non-cylindrical portion of the fuselage. The fuselage and propulsion system are preferably generally elliptical in cross section, with a dimensional ratio of the major axis to the minor axis of from more than 1:1 to about 1.5:1. The missile further includes a guidance system and guidance control features.

10 Claims, 2 Drawing Sheets

MISSILE HAVING NON-CYLINDRICAL PROPULSION SECTION

BACKGROUND OF THE INVENTION

This invention relates to guided missiles, and, more particularly, to a guided missile having a fuselage and/or a propulsion system that are not cylindrical.

A guided missile includes a fuselage or body, with a propulsion system that is usually located in the tail of the fuselage. The propulsion system can be either a solid-propellant motor or a liquid-propellant engine, but most often solid-propellant motors are used because of logistical considerations. The missile incorporates guidance and control systems, which usually include a guidance controller that drives movable control surfaces to direct the course of the missile.

There is a desire to improve the, performance of a missile by increasing its speed, range, and maneuverability. For example, a high-energy fuel is used, within the constraint that the fuel must be sufficiently stable to permit its handling under a wide variety of operational conditions. The aerodynamic design of the missile is optimized to minimize the drag that slows the missile. The diameter and length of the missile can be increased to hold more fuel. However, there are limitations on the external configuration and size of the missile. The missile must be compatible with its required launch platform such as the ordnance racks of an aircraft in the case of an air-launched missile. The larger the size of the missile, the greater its aerodynamic drag. Any design change of the missile also must not compromise its required maneuverability. Thus, the configuration of the missile cannot be arbitrarily varied.

There is a need for a missile having improved performance while satisfying externally imposed design constraints. The present invention fulfills this need, and further provides related advantages.

SUMMARY OF THE INVENTION

The present invention provides a highly maneuverable missile and a method for increasing the performance of such a missile. The missile of the invention achieves improved performance as compared with a conventional missile, with little adverse effect on maneuverability. The missile is fully compatible with external physical constraints. The improved missile can be fabricated using known manufacturing technologies.

In accordance with one embodiment of the invention, a missile comprises an elongated fuselage having a nose, a tail, and an axis of elongation, and a propulsion system disposed within a portion of the elongated fuselage. At least a portion of the propulsion system has a noncircular cross section perpendicular to the axis of elongation. The missile further includes means for guiding and controlling the direction of flight of the fuselage.

In another embodiment, a missile comprises an elongated fuselage having a nose, a tail, and an axis of elongation. At least that portion of the length of the fuselage adjacent to the tail is noncircular in cross section perpendicular to the axis of elongation. The noncircular portion has a fuselage major axis and a fuselage minor axis, and the ratio of the dimensions of the fuselage major axis to the fuselage minor axis is from greater than 1.0:1 to about 1.5:1. There is further a propulsion system disposed within the noncircular portion of the fuselage, and means for guiding and controlling the direction of flight of the fuselage.

The present invention is preferably used in relation to high-speed, high-maneuverability missiles such as air-to-air and ground-to-air intercept missiles. Intercept missiles must be able to change their flight direction rapidly and in arbitrary directions. Such intercept-type missiles are therefore distinct in their maneuvering requirements from missiles used against primarily stationary targets, such as cruise missiles, which are designed to achieve a long operational range with maneuverability considerations secondary.

It has been conventional practice that the fuselage of such an intercept missile is substantially cylindrically symmetric about its axis of elongation, such that there is a circular cross section when viewed perpendicular to the axis of elongation. There may be minor departures from perfect cylindrical symmetry due to access doors, externally projecting instrumentation, and the like, but the object has been to build the fuselage of the conventional intercept missile as nearly cylindrically symmetric as possible. Cylindrical symmetry yields the lowest surface area for a required internal volume, and consequently has the lowest skin drag. Cylindrical symmetry also is conducive to high maneuverability in any direction and simplicity in the guidance and control of the missile.

The present invention departs from this conventional approach by utilizing a non-cylindrical cross-sectional shape of the fuselage and/or a non-cylindrical cross-sectional shape of the propulsion system, over at least a portion of the length. The cross-sectional shape of the fuselage, which is desirably generally elliptical but need not be generally elliptical or even symmetric, has an aspect ratio of major axis to minor axis of from more than 1:1 to about 1.5:1, most preferably about 7.7:7.0–8.0:7.0 (i.e., about 1.10:1 to about 1.15 to 1). Such a non-cylindrical fuselage achieves a net performance improvement resulting from its increased volume and the resulting ability to carry more fuel than possible with a cylindrical volume, even though there is also slightly more skin drag than experienced with the cylindrical missile. The increase in skin drag and effects on maneuverability are minimized by blending the sectional change, if any, into the structure and also by "hiding" behind any existing drag-inducing features that must be present for other reasons. The non-cylindrical missile also is compatible with external physical and mission constraints. Existing guidance and control systems are operable to control the flight path of the missile.

One desirable feature of the invention is that it may be applied in the upgrading of the performance of an existing missile. A common course of the development and implementation of a missile system is to introduce a basic missile with required performance features. An operational system is developed around the basic missile. Thus, for example, with the adoption of the missile system, crews are trained to handle and use the missile, tactics are devised for the optimal use of the missile, and storage, use, test and repair facilities are built and placed into service. That is, adoption of a missile system involves large related expenditures in addition to the purchase of each missile. At a later time, improvements may be made to the missile. Such improvements must be made within the physical constraints on the missile such as its compatibility with existing launchers, and also within the economic constraints such as maximal use of the existing operational system. The present approach of a non-cylindrical missile fuselage has been determined to be suitable for use in upgrading existing missile systems such as the AMRAAM (Advanced Medium-Range Air-to-Air Missile) in its various production forms.

In accordance with this aspect of the invention, there is provided a method for increasing the performance of a missile having a cylindrically symmetric fuselage with a predetermined diameter, and having a baseline propulsion system mounted within the cylindrically symmetric fuselage. This method comprises the steps of substituting for the cylindrically symmetric fuselage a non-cylindrical elongated fuselage having a nose, a tail, and an axis of elongation. At least that portion of the length of the fuselage adjacent to the tail has a generally elliptical cross section perpendicular to the axis of elongation. A propulsion system having a generally elliptical cross section is mounted within that portion of the non-cylindrical fuselage that has the generally elliptical cross section and is adjacent to the tail. Means for guiding and controlling the direction of flight of the fuselage is provided.

The present invention thus provides an important advance in the art of missiles. The performance of the missile is improved without changing the type of fuel, only its amount, by increasing the volume available to contain the fuel. The volume increase results in slightly increased drag, but this increased drag is more than offset by the increased amount of fuel available. The approach of the invention can be used both in the design of new missiles and in the upgrading of existing missiles. Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Figure 1:
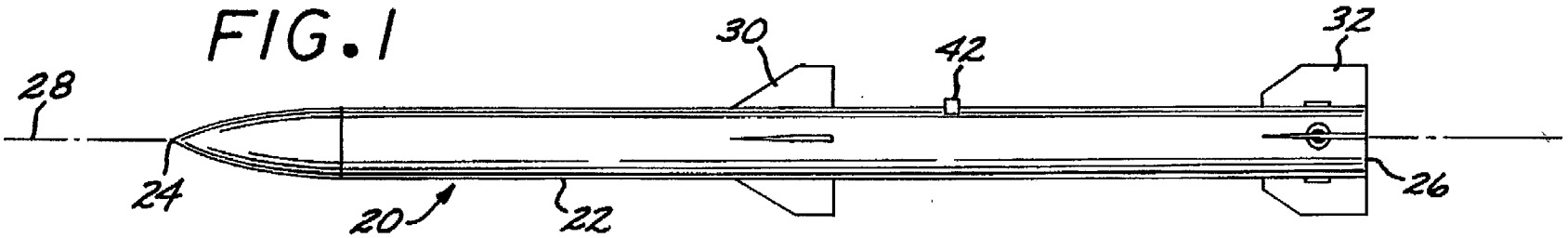
FIG. 1 is a side elevational view of a missile.
Figure 2:
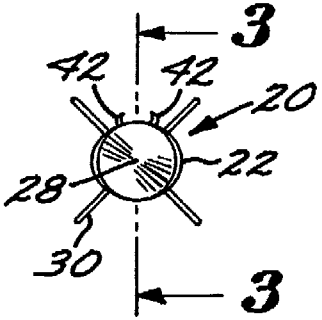
FIG. 2 is a front elevational view of the missile of FIG. 1.

FIGS. 1 and 2 depict a missile 20 having a fuselage 22 with a nose 24, a tail 26, and an axis of elongation 28. Four fixed winglets 30 extend outwardly from the fuselage 22 and are spaced equally 90 degrees from each other around the periphery of the fuselage. The fixed winglets 30 are positioned at about the midpoint of the fuselage 22, roughly equidistant between the nose 24 and the tail 26. Four movable control surfaces 32 extend outwardly from the fuselage 22 and are spaced equally 90 degrees from each other around the periphery of the fuselage. The movable control surfaces 32 are positioned adjacent to the tail 26 of the fuselage 22.

Figure 3:
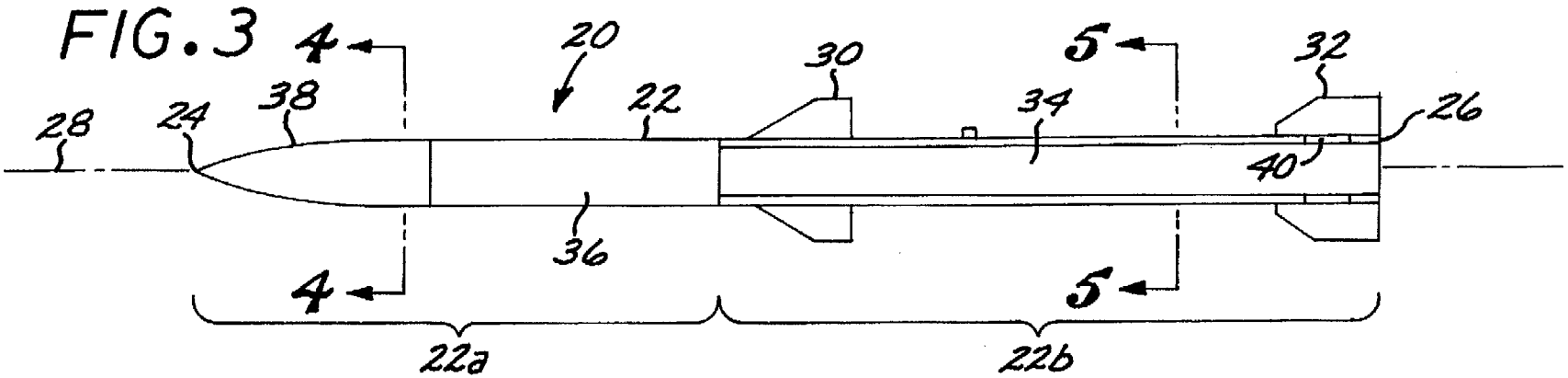
FIG. 3 is a schematic sectional view of the missile of FIG. 2, taken along line 3—3.

FIG. 3 is a sectional view illustrating the interior features within the fuselage 22 in general terms. The missile 20 includes a propulsion system 34 extending forwardly from the tail 26 in a rearward end of the fuselage 22. The propulsion system 34 may be either a solid-propellant motor or a liquid-propellant engine, but is preferably the solid-propellant motor. A warhead 36 is positioned forward of the propulsion system 34. A guidance controller 38 is located just behind the nose 24 of the missile 20, and may include a sensor in the nose 24. An actuator 40 is in mechanical communication with each of the movable control surfaces 32. Operation of the actuators 40 is commanded by the guidance controller 38, to accomplish guidance of the fuselage during powered flight. There may also be one or more sets of facing hooks 42 extending upwardly from the fuselage 22. The sets of hooks 42 are received onto a launch rail (not shown) of an aircraft or other launching device, and support the missile 20 on the aircraft prior to launching.

Figure 4:
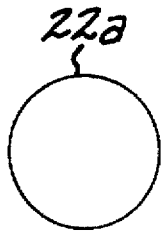
FIG. 4 is a schematic enlarged sectional view of the missile of FIG. 3 near its nose, taken generally along line 4—4.
Figure 5:
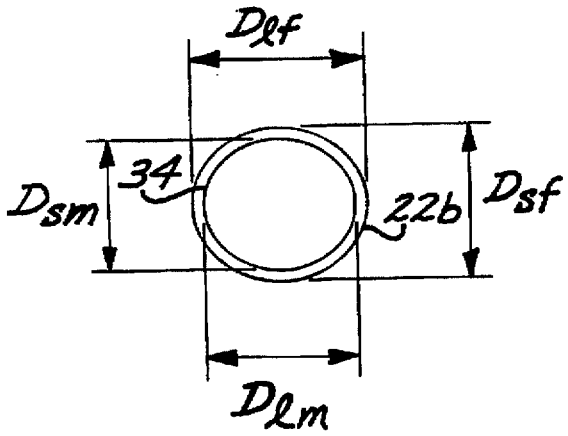
FIG. 5 is a schematic enlarged sectional view of the missile of FIG. 3 near its tail, taken generally along line 5—5.

FIGS. 4 and 5 depict the preferred cross-sectional shape of the fuselage 22 at two locations along the length of the fuselage. At one location, as shown in FIG. 4, the portion of the length of the fuselage **22*a* is substantially circular in cross section, so that the portion of the length of the fuselage 22*a* is a circular cylinder. At a second location, as shown in FIG. 5, the portion of the length of the fuselage 22*b* has a noncircular cross section, so that the portion of the length of the fuselage 22*b* is not a circular cylinder. The portion of the fuselage 22*a* preferably includes the guidance controller 38 and the warhead 36. The portion of the fuselage 22*b* preferably includes the propulsion system 34. The propulsion system 34 is also of noncircular cross section, so that at least a portion of its length is not a circular cylinder. The portions 22*a* and 22*b* can extend over different regions of the fuselage of the missile. In another, but less preferred, embodiment, the noncylindrical portion 22*b* extends over substantially the entire length of the fuselage 22. The noncircular portion of the length of the fuselage 22*b* preferably has a "generally elliptical" cross section. As used herein, the term "generally elliptical" relates to a noncircular planar figure having two-fold symmetry and a generally curved periphery, and having a major (longer) axis $D_1$ and a minor (shorter) axis $D_s$. The term "generally elliptical" includes figures which are precisely mathematically elliptical, but also includes figures that are not precisely mathematically elliptical in shape but are close to or substantially of such a shape. FIG. 5 depicts the longer and shorter axes for the preferred generally elliptical fuselage portion 22*b* ($D_{1f}$ and $D_{sf}$) and the propulsion system 34** ($D_{1m}$ and $D_{sm}$).

The use of a generally elliptical cross-sectional shape in the portion of the fuselage **22*b* permits the propulsion system 34** to be generally elliptical in cross section as well, and preferably the propulsion system is of such a cross-sectional shape. The propulsion system of generally elliptical cross-sectional shape contains a greater volume of propellant than a circularly symmetric propulsion system whose diameter is the same as the minor axis of the propulsion system having a generally elliptical cross sectional shape. However, there is also a larger skin friction drag during flight associated with the fuselage of generally elliptical cross sectional shape, and the absence of circular symmetry complicates autopilot control of the missile. As the ratio $D_{1f}:D_{sf}$ becomes larger, the weight of the fuselage and propulsion system containment structure increases because of the introduction of non-symmetric hoop stresses into the structures.

Studies by the inventors have shown that over certain ranges of the ratio of the length of the major axis to the length of the minor axis, $D_{1f}:D_{sf}$, the increased propellant volume more than offsets the increased drag and results in improved performance of the missile. The absence of circular symmetry as related to controllability and maneuverability can be offset with the existing computer control technology available in missile systems.

Thus, the ratio of the length of the fuselage major axis to the length of the minor axis, $D_{1f}:D_{sf}$, is greater than 1:1, so that the fuselage portion 22b is not circular and can hold an increased volume of propellant. The ratio of the length of the major axis to the length of the minor axis, $D_{1f}:D_{sf}$, is less than about 1.5:1. If the ratio of the length of the major axis to the length of the minor axis is more than about 1.5:1, the increase of the skin friction drag of the fuselage during flight relative to the added volume of the missile available for additional rocket propellant becomes comparatively large in high-speed flight, and the missile controllability and maneuverability in high rate-of-response maneuvering are unacceptably degraded. The weight of the fuselage and propulsion system containment structures increases unacceptably, and negates the beneficial effect of the added fuel volume. If the ratio $D_{1f}:D_{sf}$ becomes substantially larger than about 1.5:1, the effectiveness of movable control surfaces is reduced during some types of high-angle turning maneuvers due to a "shadowing" effect of the noncircular fuselage. Thus, higher ratios might be operable in low-maneuverability missiles where added lift produced by the high ratio contributes to the range of the missile, but such higher ratios would not be operable for a high-maneuverability missile.

Most preferably, the ratio of the length of the major axis to the length of the minor axis, $D_{1f}:D_{sf}$, is from about 7.7:7.0 to about 8.0:7.0 in a modified AMRAAM missile, or, stated alternatively, in the range of from about 1.1:1 to 1.15:1.

Figure 6:
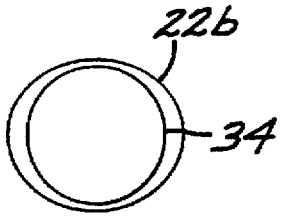
FIGS. 6–8 are schematic enlarged sectional views of other embodiments of the missile of FIG. 3 near its tail, taken generally along line 5—5.
Figure 7:
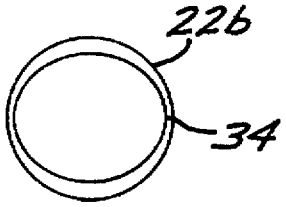
Figure 8:
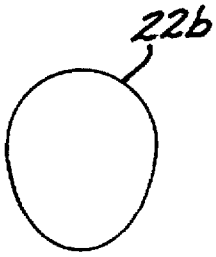

FIGS. 6–8 depict three other embodiments of the fuselage portion 22b that are within the scope of the invention, but which are less preferred than that of FIG. 5. In FIG. 6, the fuselage 22b is generally elliptical in cross section, while the propulsion system 34 is circular. The extra space between the outer wall of the propulsion system 34 and the inner wall of the fuselage 22b can be used to store fuel for the propulsion system. This embodiment is preferably used when the propulsion system 34 is a liquid-propellant engine in which the propellant is forced from the fuel storage area to a combustion chamber. In FIG. 7, the fuselage portion 22b is circularly symmetric and the propulsion system 34 is noncircular. In FIG. 8, the fuselage portion 22b is noncircular and not generally elliptical. An upper portion of the fuselage is semicircular to conform to a launcher structure, while the lower portion is somewhat elliptical. These and other noncylindrical structures are within the scope of the invention.

Figure 9:
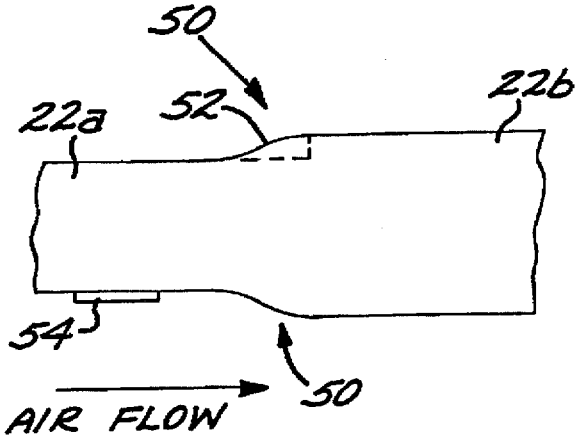
FIG. 9 is a schematic sectional view of a detail of the missile in the transition region between circular and noncircular cross sections of the fuselage, taken in the same view as FIG. 3.

In building a missile according to the preferred approach, there is necessarily a transition region between the cylindrical forward portion of the fuselage 22a and the noncylindrical aft portion of the fuselage 22b. The transition region potentially adds aerodynamic drag to the missile, but care is taken to minimize the adverse effects of such drag. FIG. 9 illustrates a transition region 50 and two techniques utilized to minimize any added drag effects resulting from the transition. The transition region is blended by a smooth aerodynamic contour 52, rather than being accomplished in a step as indicated by the dashed lines at the transition region 50. Secondly, the transition region 50 is preferably placed closely adjacent to, but rearwardly of, existing airflow-disrupting features, such as projecting instrumentation 54. The projecting feature adds drag and a turbulent wake which is present even in the cylindrical missile. Placing the transition region 50 closely behind the projecting feature, thus "hiding" the transition region behind the projecting feature, adds no or minimal drag to the missile in addition to that already present.

Studies by the inventors have shown that significant performance improvements are achieved by incorporating the present approach into the preferred missile having a fuselage and propulsion system as shown in FIG. 5. For $D_{1f}:D_{sf}$ from about 7.7:7.0 to about 8.0:7.0 in a modified AMRAAM missile, performance improves by about 15–20 percent. The maneuverability of the missile remains acceptable with these modifications, using the existing guidance and control system.

The fuselage is typically made of a metallic or a composite construction. The cylindrical and noncylindrical portions of the fuselage, and the transition region between these two portions, are readily manufactured using these materials of construction with conventional forming and/or layup techniques In another approach to improving performance, the length of the propulsion system 34 is increased while keeping the overall length of the missile 20 unchanged by reducing the lengths required for the warhead 36 and/or the guidance controller 38. In some cases, it may also be possible to increase the length of the propulsion system 34 by increasing the overall length of the fuselage of the missile slightly.

The present invention thus provides an important advance in the art of missile design. Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A missile, comprising:

an elongated fuselage having a nose, a tail, and an axis of elongation, at least that portion of the length of the fuselage adjacent to the tail being noncircular in cross section perpendicular to the axis of elongation and having a curved periphery the noncircular portion having a fuselage major axis and a fuselage minor axis and wherein the ratio of the dimensions of the fuselage major axis to the fuselage minor axis is from greater than 1.0:1 to about 1.5:1;

a propulsion system disposed within the noncircular portion of the elongated fuselage, at least a portion of the propulsion system having a noncircular cross section perpendicular to the axis of elongation and having a curved periphery;and means for guiding and controlling the direction of flight of the fuselage.

means for guiding and controlling the direction of flight of the fuselage.

2. The missile of claim 1, wherein said noncircular portion of the fuselage has a generally elliptical cross section perpendicular to the axis of elongation.

3. The missile of claim 1, wherein said noncircular portion of the propulsion system has a generally elliptical cross section perpendicular, to the axis of elongation.

4. The missile of claim 1, wherein said noncircular portion of the propulsion system has a generally elliptical cross section perpendicular to the axis of elongation, and wherein the generally elliptical portion of the propulsion system has a propulsion-system major axis and a propulsion-system minor axis, the ratio of the dimensions of the propulsion-system major axis to the propulsion-system minor axis being from more than 1.0:1 to about 1.5:1.

5. The missile of claim 1, wherein the noncircular portion of the propulsion system has a propulsion-system major axis and a propulsion-system minor axis, and the ratio of the dimensions of the propulsion-system major axis to the propulsion-system minor axis is from more than 1.0:1 to about 1.5:1.

6. The missile of claim 5, wherein the ratio of the dimensions of the propulsion-system major axis to the propulsion-system minor axis is from about 1.10:1 to about 1.15:1.

7. The missile of claim 1, wherein the propulsion system is a solid-propellant rocket motor.

8. The missile of claim 1, wherein the means for guiding and controlling comprises at least two movable control surfaces, and an actuator for each of the control surfaces.

9. The missile of claim 1, wherein a first portion of the fuselage is circular in cross section.

10. A method for increasing the performance of a missile having a cylindrically symmetric fuselage with a predetermined diameter, and having a baseline propulsion system mounted within the cylindrically symmetric fuselage, comprising the steps of:

substituting for the cylindrically symmetric fuselage a non-cylindrical elongated fuselage having a nose, a tail, and an axis of elongation, at least that portion of the length of the fuselage adjacent to the tail having a noncircular cross section when viewed perpendicular to the axis of elongation and having a curved periphery the noncircular portion having a fuselage major axis and a fuselage minor axis and wherein the ratio of the dimensions of the fuselage major axis to the fuselage minor axis is from greater than 1.0:1 to about 1.5:1;

mounting a propulsion system having a noncircular cross section when viewed perpendicular to the axis of elongation and having a curved periphery within that portion of the non-cylindrical fuselage that has, the noncircular cross section and is adjacent to the tail; and providing means for guiding and controlling the direction of flight of the fuselage.

* * * * *